US006035747A

United States Patent [19]

Valela

[11] Patent Number: 6,035,747

[45] Date of Patent: Mar. 14, 2000

[54] EXTENSION BAR FOR SOCKET WRENCHES HAVING IMPROVED TORQUE CHARACTERISTICS

[76] Inventor: Joseph Valela, P.O. Box 881, Dillingham, Ak. 99576

[21] Appl. No.: 09/145,708

[22] Filed: Sep. 1, 1998

[51] Int. Cl.[7] ..... B25B 23/16

[52] U.S. Cl. ..... 81/177.2; 81/177.85

[58] Field of Search ..... 87/177.2, 177.85

[56] References Cited

U.S. PATENT DOCUMENTS

| | | | |
|---|---|---|---|
| 4,056,020 | 11/1977 | Coviello | 81/188.2 |
| 4,344,340 | 8/1982 | Erickson | 81/177.2 |
| 4,703,677 | 11/1987 | Rossini | 81/177.2 |
| 4,733,584 | 3/1988 | Karge | 81/177.2 |
| 4,781,085 | 11/1988 | Fox, III | 81/177.85 |
| 4,960,015 | 10/1990 | Mathews | 81/177.2 |
| 5,291,809 | 3/1994 | Fox, III et al. | 81/177.2 |
| 5,477,434 | 12/1995 | Reed | 81/177.2 |
| 5,720,207 | 2/1998 | Milner et al. | 81/177.2 |

*Primary Examiner*—David A. Scherbel
*Assistant Examiner*—Joni B. Danganan
*Attorney, Agent, or Firm*—Michael J. Tavella

[57] ABSTRACT

An extension bar that has a cylindrical hollow shaft that has two solid ends for use with socket type wrenches. At one end, a solid piece of metal is machined to a post to receive the socket. At the other end, the solid member has a recess formed in it to receive the post of the socket wrench. Unlike the extension bars available today, the recess for the socket wrench does not penetrate into the hollow shaft. This construction, unlike the others, prevents the extension from twisting when torque is applied by the wrench. Instead of having to overcome the twisting force before torque is applied to a fastener, the torque is transmitted directly to the fastener. This type of extension bar can be made in any length, even three or four feet. Even at those lengths, the extension does not twist. As a result, repair operations are faster and safer.

1 Claim, 4 Drawing Sheets

EXTENSION BAR FOR SOCKET WRENCHES HAVING IMPROVED TORQUE CHARACTERISTICS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to extension bars for socket wrenches and particularly to extension bar for socket wrenches having improved torque characteristics.

2. Description of Related Art

Socket wrenches have been in use for many years. Extension bars are a common accessory frequently used with socket wrenches. Because of the shape of the socket wrenches, they often can not reach into narrow or confined spaces. The extension bar is then used to project the socket itself into the confined space. Typically, these bars are actually round shafts of metal. Often the shafts are solid, having an opening for the socket wrench on one end and a post to receive the socket at the other end. Sometimes, the extension bars are hollow shafts that have the post on one end and a flared end at the other end to receive the socket wrench. In both cases, these extensions suffer from one major flaw. The shafts twist when torque is applied. Therefore, in many cases, considerable force must be applied to the wrench to overcome this twisting of the extension bar before force is applied to the bolt or nut to be loosened. This twisting becomes more pronounced as the length of the extension bar increases. For extreme lengths of extensions (three or four feet), the amount of twist may be so great that it is virtually impossible to impart force on the nut. The shaft of the extension simply absorbs all the torque that is applied by the wrench.

FIG. 1 shows a free body diagram of a typical extension bar 100 as prior art. A socket wrench 101 applies a rotational force F onto the shaft. The extension bar 100 is shown rotating about the central axis. Socket 102 is shown remaining stationary even though the force is being applied to the shaft. The socket 102 remains stationary until the twist in the shaft is fully absorbed. At that point, torque can be transmitted to the socket head to work a fastener (not shown).

BRIEF SUMMARY OF THE INVENTION

The instant invention overcomes this problem. It is an extension bar that has a cylindrical hollow shaft that has two solid ends. At one end, a solid piece of metal is machined to a post to receive the socket. At the other end, the solid member has a recess formed in it to receive the post of the socket wrench. Unlike the extension bars available today, the recess for the socket wrench does not penetrate into the hollow shaft. This construction, unlike the others, prevents the extension from twisting when torque is applied by the wrench. Instead of having to overcome the twisting force before torque is applied to a fastener, the torque is transmitted directly to the fastener. This type of extension bar can be made in any length, even three or four feet. Even at those lengths, the extension does not twist. As a result, repair operations are faster and safer.

It is an object of this invention to produce an extension bar for socket wrenches that does not twist when torque is applied.

It is also an object of this invention to produce an extension bar for socket wrenches that transmits the turning force of a socket wrench directly to a fastener.

DETAILED DESCRIPTION OF THE INVENTION

Figure 1:
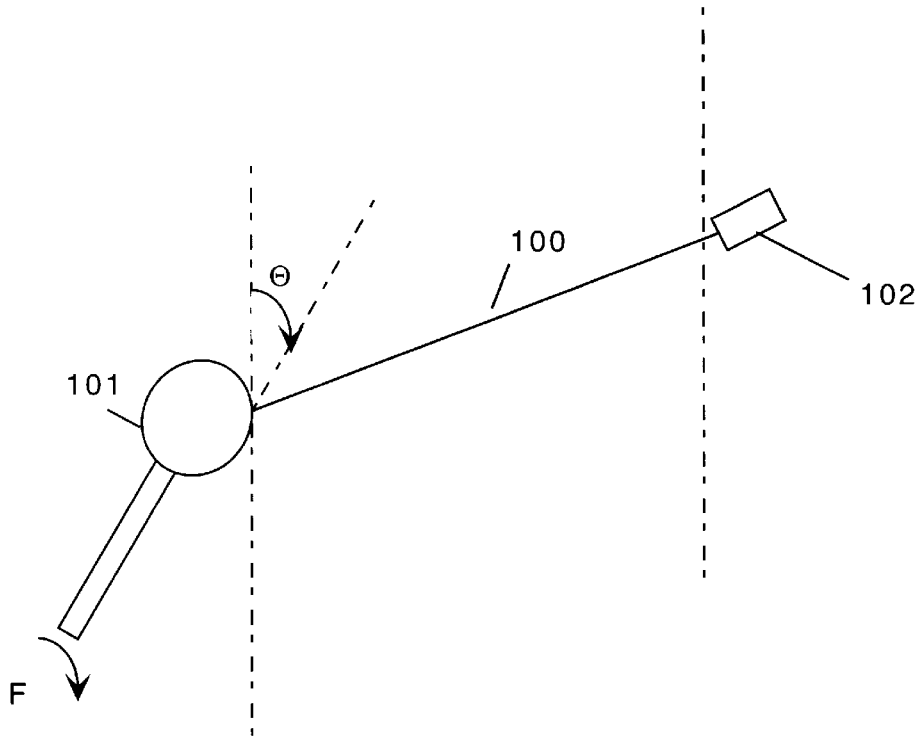
Figure 1 Prior Art
FIG. 1 is a free body diagram of a typical extension bar as prior art showing the twist in the shaft when torque is applied by a wrench.
Figure 2:
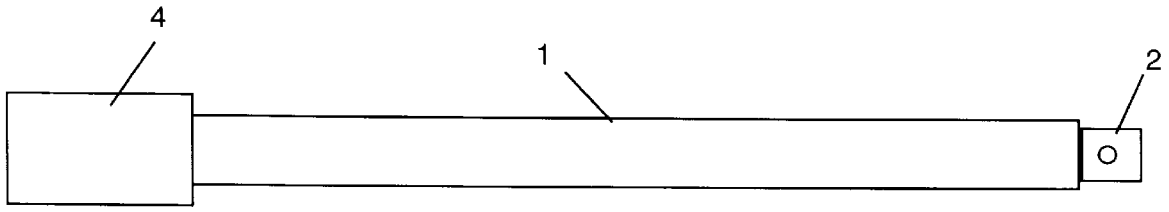
FIG. 2 is a side view of the invention.

Referring now to FIG. 2 a side view of the extension bar 1 is shown. The outward appearance of the extension bar 1 is identical to all other extension bars. At one end of the extension bar 1 is a post 2 that is used to hold a socket 102. At the other end of the extension is a member 4 that has a recess 5 formed in it to receive a socket wrench (not shown). See also FIGS. 3 and 4.

Figure 3:
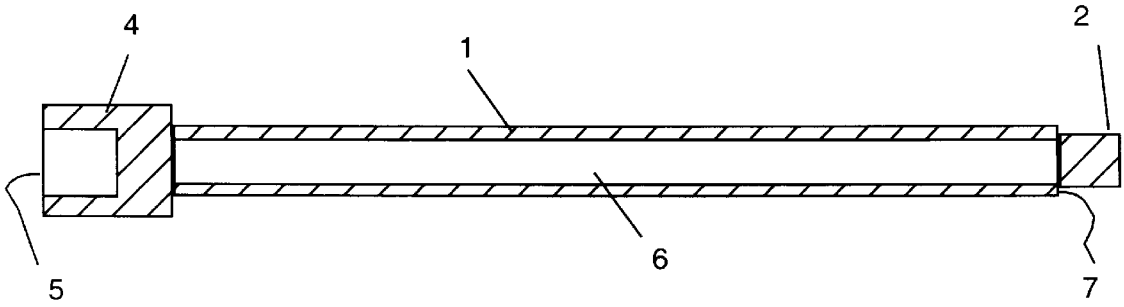
FIG. 3 is a cross-sectional view of the invention.

FIG. 3 is a cross-sectional view of the shaft 1. Here, the shaft tube 6 is hollow as shown. The post 2 is formed from a solid member/cover plate 7 that is attached to the hollow tube 6 as shown. Similarly, the member 4 is also formed of a solid mass that has the recess 5 formed in it. Note that the recess 5 does not penetrate into the hollow shaft tube 6 as shown. A solid mass of material separates the recess 5 from the hollow tube 6. This solid mass of material is important in that without it, the hollow mass twists just like a completely solid mass.

The extension may be made by taking a hollow shaft and adding a cover plate that has a diameter corresponding to the diameter of one end of the hollow shaft. The cover is permanently attached to the hollow shaft. A post attaches to the cover plate and extends outward from the cover plate. The post is used for receiving sockets. At the other end of the shaft a wrench-receiving member, is attached. This member is a solid body that has a recess or cavity formed in it to receive the end of a socket type wrench. As noted above, the wrench-receiving member has a solid bottom the connects to the hollow shaft. As before, the cavity does not penetrate into the hollow shaft. When completed, this assembly looks like the device shown in FIG. 2.

Figure 4:
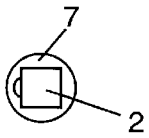
FIG. 4 is a top end view of the invention.
Figure 5:
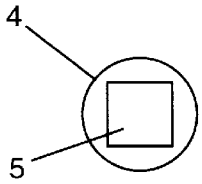
FIG. 5 is a bottom end view of the invention.

FIG. 4 is an end view of the extension showing the post 2. FIG. 5 is an end view of the extension showing the recess 5.

Figure 6A:
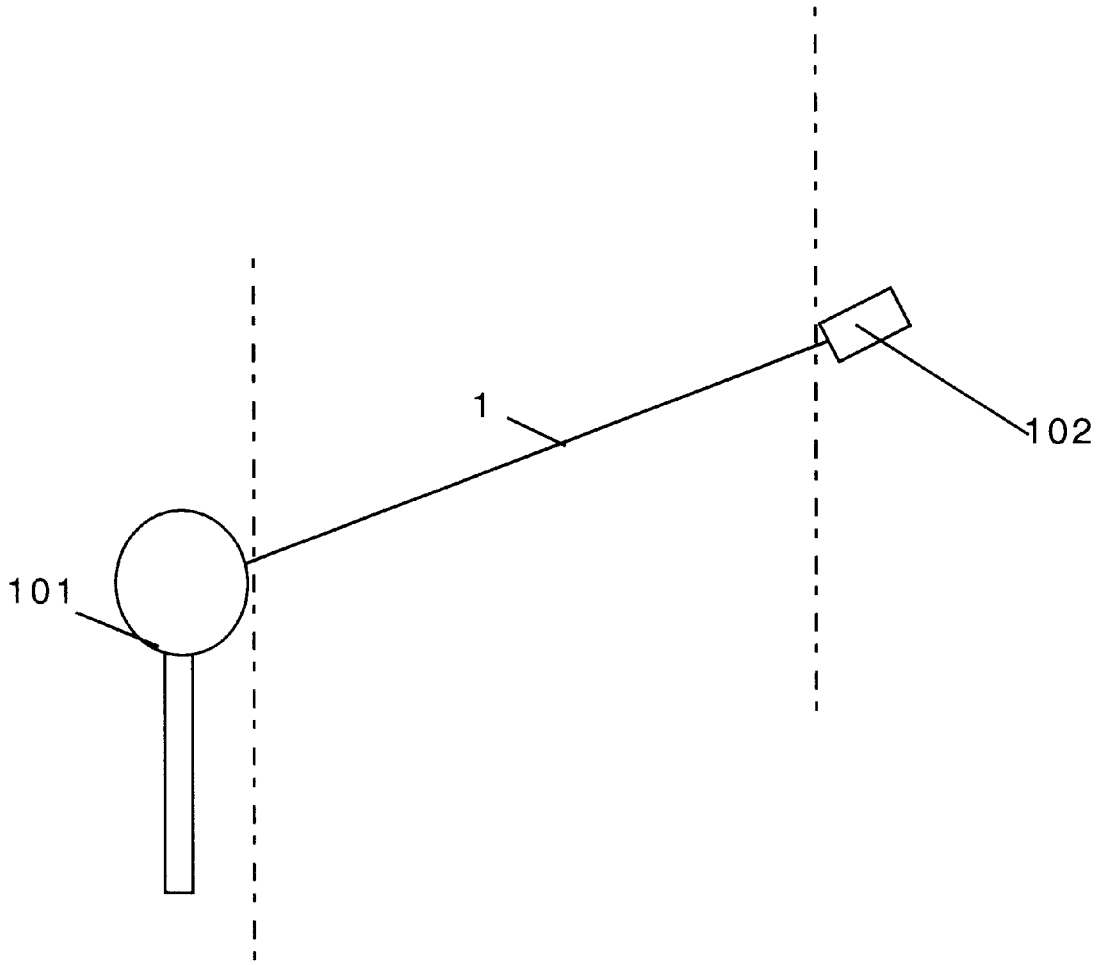
FIG. 6*a* is a free body diagram of the invention just prior to applying a force to the wrench, showing all components in alignment.
Figure 6B:
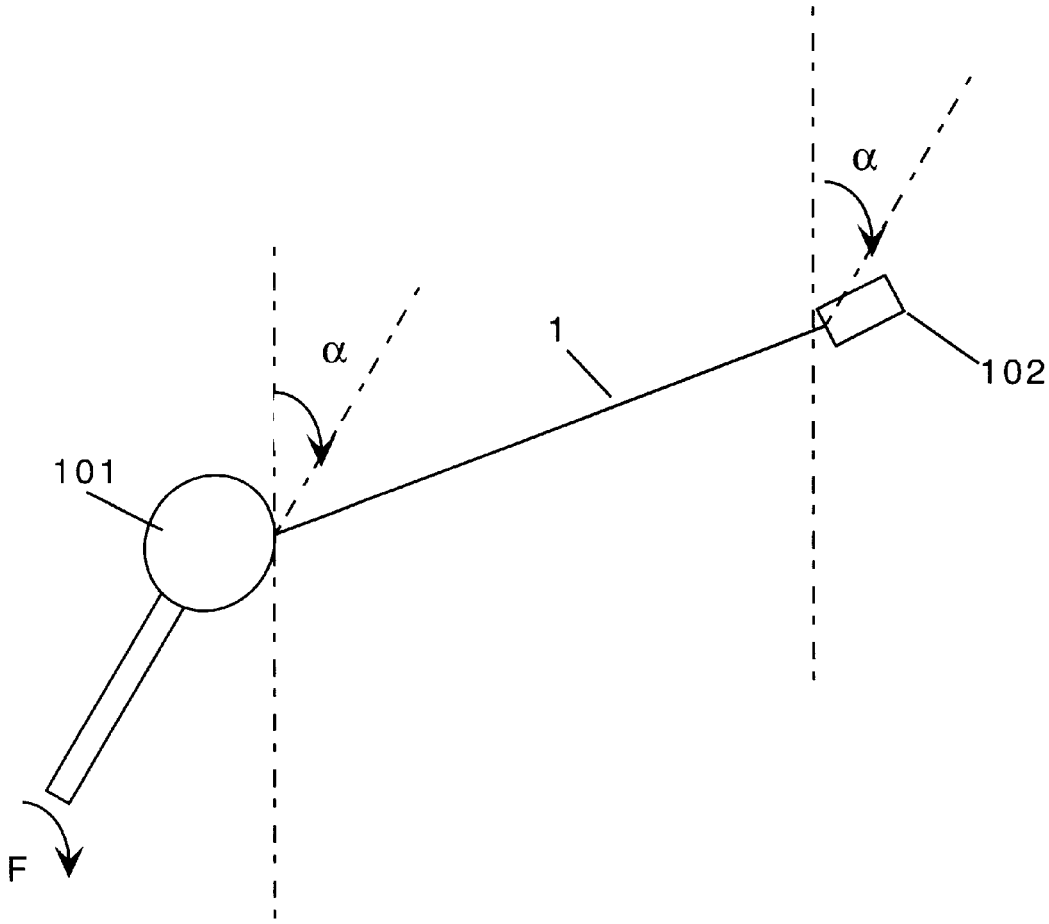
FIG. 6*b* is a free body diagram of the invention after force is applied to the wrench, showing no twist in the shaft when torque is applied by a wrench.

FIG. 6*a* is a free body diagram of the extension 1. In this diagram, the socket wrench 101 is shown just before applying a rotational force F to the extension. Here, the wrench and socket are aligned as shown. FIG. 6*b* is the same free body diagram just after the force F has been applied. Here, the socket wrench 101 has been rotated to certain angle $\alpha$. In this diagram note that the shaft has rotated the socket 102 by the same angle $\alpha$.

The figure illustrates that the shaft of the present invention does not twist when torque is applied. It is the combination of a hollow shaft and solid ends that eliminates this twisting in the shaft.

As a result of this improvement, extension bars up to 4 and 5 feet long are possible to build and use. Before, such long solid extension bars were unusable because their length created so much twist, that no reasonable amount of force could be applied to the long shafts and still have torque transmitted to the fastener at the other end. My new shaft, however, has no twist. Therefore, my invention improves performance for both short and long length shafts. In both cases, all the force applied is transmitted to the fastener at the other end.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An extension bar for use with socket type wrenches comprising:

a) a hollow shaft, having a first end and a second end, said hollow shaft also having a diameter;

b) a cover plate, having a diameter corresponding to the diameter of the first end of said hollow shaft, said cover plate being fixedly attached to the first end of said hollow shaft;

c) a post, fixedly attached to the cover plate and extending outwardly therefrom, wherein said post being used for receiving sockets;

d) a wrench receiving member, having a body having a depth, said wrench receiving member being fixedly attached to said second end of said hollow shaft, said wrench receiving member also having a recess formed therein to receive a socket wrench, said recess having a depth less than the depth of said wrench receiving member.

* * * * *